US009777662B2

(12) United States Patent
Richter et al.

(10) Patent No.: US 9,777,662 B2
(45) Date of Patent: Oct. 3, 2017

(54) METHOD AND DEVICE FOR OPERATING A FUEL DELIVERY DEVICE OF AN INTERNAL COMBUSTION ENGINE

(75) Inventors: Uwe Richter, Markgroeningen (DE); Burkhard Hiller, Oberriexingen (DE); Joerg Kuempel, Ludwigsburg (DE); Rainer Winkler, Valhingen/Enz (DE); Heiko Roth, Heilbronn (DE)

(73) Assignee: Robert Bosch GmbH, Stuttgart (DE)

( * ) Notice: Subject to any disclaimer, the term of this patent is extended or adjusted under 35 U.S.C. 154(b) by 457 days.

(21) Appl. No.: 14/128,599

(22) PCT Filed: May 2, 2012

(86) PCT No.: PCT/EP2012/057985

§ 371 (c)(1),
(2), (4) Date: Jun. 5, 2014

(87) PCT Pub. No.: WO2012/175247

PCT Pub. Date: Dec. 27, 2012

(65) Prior Publication Data

US 2014/0311456 A1 Oct. 23, 2014

(30) Foreign Application Priority Data

Jun. 22, 2011 (DE) ..... 10 2011 077 991

(51) Int. Cl.
*F02M 51/00* (2006.01)
*F02D 41/30* (2006.01)
*F02D 41/38* (2006.01)

(52) U.S. Cl.
CPC ..... *F02D 41/30* (2013.01); *F02D 41/3845* (2013.01)

(58) Field of Classification Search
CPC ..... F02D 41/30; F02D 41/3845
(Continued)

(56) References Cited

U.S. PATENT DOCUMENTS 7,398,768 B2 * 7/2008 Usui ..... F02D 41/20 123/446
2004/0000289 A1 * 1/2004 Seo ..... F02M 59/022 123/447

(Continued)

FOREIGN PATENT DOCUMENTS

CN 1179508 A 4/1998
CN 1403697 A 3/2003

(Continued)

OTHER PUBLICATIONS

International Search Report corresponding to PCT Application No. PCT/EP2012/057985, mailed Sep. 21, 2012 (German and English language document) (5 pages).

*Primary Examiner* — Hung Q Nguyen
(74) *Attorney, Agent, or Firm* — Maginot, Moore & Beck LLP

(57) ABSTRACT

A method for operating a fuel delivery device of an internal combustion engine includes switching an electromagnetic actuating device of a volume control valve so as to set a delivery volume. An intensity of an energy that is supplied to the electromagnetic actuating device for switching purposes, in particular of a current supplied to the electromagnetic actuating device and/or a level of a voltage applied to the electromagnetic actuating device, depends at least intermittently on a rotational speed of the internal combustion engine.

7 Claims, 4 Drawing Sheets

(58) Field of Classification Search
USPC ..... 123/458, 446, 506
See application file for complete search history.

(56) References Cited

U.S. PATENT DOCUMENTS

| | | | | |
|---|---|---|---|---|
| 2005/0126539 | A1* | 6/2005 | Okamoto | F02D 41/062 123/446 |
| 2005/0211224 | A1 | 9/2005 | Inaguma et al. | |
| 2011/0023686 | A1* | 2/2011 | Nakata | G10D 13/025 84/415 |

FOREIGN PATENT DOCUMENTS

| | | | |
|---|---|---|---|
| CN | 101387250 | A | 3/2009 |
| CN | 101479458 | A | 7/2009 |
| DE | 102 40 069 | A1 | 3/2003 |
| EP | 0 732 492 | | 9/1996 |
| EP | 0 899 437 | | 3/1999 |
| EP | 1 042 607 | B1 | 2/2000 |
| EP | 1 234 971 | A2 | 8/2002 |
| JP | 55-10093 | A | 1/1980 |
| JP | 60-243340 | A | 12/1985 |
| JP | 2000-136747 | A | 5/2000 |
| JP | 2002-243145 | A | 8/2002 |
| JP | 2005-54665 | A | 3/2005 |
| JP | 2005-291213 | A | 10/2005 |
| JP | 2007-40361 | A | 2/2007 |
| JP | 2008-31947 | A | 2/2008 |
| JP | 2010-270713 | A | 12/2010 |

* cited by examiner

METHOD AND DEVICE FOR OPERATING A FUEL DELIVERY DEVICE OF AN INTERNAL COMBUSTION ENGINE

This application is a 35 U.S.C. §371 National Stage Application of PCT/EP2012/057985, filed on May 2, 2012, which claims the benefit of priority to Serial No. DE 10 2011 077 991.4, filed on Jun. 22, 2011 in Germany, the disclosures of which are incorporated herein by reference in their entirety.

BACKGROUND

The disclosure relates to a method as described herein, and to a computer program and to an open-loop and/or a closed-loop control device as described herein.

Quantity control valves, for example in a fuel delivery device of an internal combustion engine, are known commercially. Quantity control valves are generally operated electromagnetically and are frequently an integral component of a high pressure pump of the fuel delivery device. The quantity control valve controls the fuel quantity pumped to a high pressure accumulator ("rail") from where fuel is conducted to the injection valves of the internal combustion engine. An armature which is coupled to a valve body of the quantity control valve can be moved by magnetic force. The valve body, usually an inlet valve of the high pressure pump, can impact against a valve seat, or be lifted off from the valve seat. As a result, a fuel quantity of the internal combustion engine can be regulated.

A patent publication from this specialist field is, for example, EP 1 042 607 B1.

SUMMARY

The problem on which the disclosure is based is solved by a method as described herein and by a computer program and an open-loop and/or closed-loop control device according to the disclosure. Advantageous developments are specified herein. Features which are important for the disclosure are also to be found in the following description and in the drawings, wherein the features may be important for the disclosure either alone or in different combinations, without being explicitly referred to again.

The method according to the disclosure has the advantage that a quantity control valve (metering device) of a fuel delivery device can be activated with comparatively little electrical energy, in particular while an internal combustion engine is operated at medium or low rotational speeds. The operational noise of the quantity control valve can be reduced and the endurance strength increased.

The disclosure relates to a method for operating a fuel delivery device of an internal combustion engine, in which, in order to set a delivery quantity, an electromagnetic activation device of a quantity control valve, arranged in an inflow of a delivery space of the fuel delivery device, is switched. For this purpose, during every switching process during which an armature is to be moved in the direction of a stroke stop, energy is fed to the electromagnetic activation device by means of the actuation. For example, the switching of the quantity control valve takes place twice, three times or even four times during one rotation of a cam shaft of the internal combustion engine. Comparatively high levels of energy are necessary to reliably switch the quantity control valve and to achieve short switching times even at the highest possible rotational speed of the cam shaft and/or of the internal combustion engine.

The disclosure is based on the idea that at rotational speeds below the maximum rotational speed the requirement for a short switching time is correspondingly less critical. As a result, according to the disclosure, the amount of energy which is fed to the electromagnetic activation device for the purpose of switching, in particular the amount of current which is fed to the electromagnetic activation device and/or a level of a voltage which is applied to the electromagnetic activation device, is made to depend at least for a certain time on a rotational speed of the cam shaft or of the internal combustion engine, specifically to the effect that it is smaller at low rotational speeds than at high ones.

One refinement of the disclosure provides that the energy depends on the rotational speed of the internal combustion engine only during an attraction phase during which the armature of the electromagnetic activation device is moved from a first into a second position. The attraction phase requires a particularly large amount of energy in order to achieve a respectively required short switching time. The necessary dependence of the actuation on the rotational speed of the internal combustion engine during the attraction phase is therefore particularly efficient. The actuation of the electromagnetic activation device during a holding phase following the attraction phase can take place substantially independently of the rotational speed.

Furthermore there is provision that the energy is increased with a rising rotational speed, wherein the relationship is monotonous. This takes into account the fact that the movement of the armature has to occur generally more quickly in accordance with the rotational speed. This preferably occurs using a continuous and monotonous characteristic curve.

In particular there is provision that the energy is controlled in such a way that the quantity control valve can be switched reliably within a time interval which is provided for a respective rotational speed. The time interval is generally longer for relatively low rotational speeds than for relatively high rotational speeds and is to be respectively dimensioned in such a way that the quantity control valve can operate correctly. The room for maneuver in terms of timing which is possible as a result is used according to the disclosure to extend an attraction duration of the armature at low rotational speeds within the scope of the respective time interval. This requires a respectively smaller quantity of energy.

One refinement of the method provides that the current and/or the voltage for actuating the electromagnetic activation device are clocked. For example, the electromagnetic activation device is connected to an operating voltage repeatedly by means of an electronic switch during the attraction phase and/or the holding phase of the armature and it is disconnected therefrom again. A pulse duty factor which is set in the process therefore determines the average current during the actuation. The pulse duty factor is set in such a way that the average current depends on the rotational speed of the internal combustion engine. The electronic switch is preferably activated as a function of in each case a lower and an upper current threshold. If the current flowing through a coil of the electromagnetic activation device undershoots the lower current threshold, the electronic switch is closed and therefore the coil is connected to the operating voltage. As a result, the current flowing via the coil, and a magnetic force brought about as a result, increase continuously. If the current flowing through the coil exceeds the upper current threshold, the electronic switch is opened and therefore the coil is disconnected from the operating voltage. This reduces the current flowing via the coil, and correspondingly the magnetic force, continuously. In general, the current thresholds used for the attraction phase and the holding phase are respectively different.

As an alternative to using current thresholds it is also possible to actuate the electromagnetic activation device by means of a "pilot-controlled" pulse-width-modulated voltage, wherein the determining parameters for at least one actuation in each case are set in advance. According to the disclosure, these parameters are set in such a way that the quantity of energy fed to the electromagnetic activation device for the purpose of switching depends at least for a certain time on the rotational speed of the internal combustion engine.

The method can be carried out particularly easily if it is carried out by means of a computer program on an open-loop and/or closed-loop control device ("control unit") of the internal combustion engine. In one preferred refinement, the control unit is set up by loading the computer program with the features described herein from a storage medium. The storage medium is understood in this respect to be any device which contains the computer program in a stored form.

BRIEF DESCRIPTION OF THE DRAWINGS

Exemplary embodiments of the disclosure are explained below with reference to the drawings, in which.

DETAILED DESCRIPTION

In all the figures, the same reference symbols are used for functionally equivalent elements and variables even in different embodiments.

Figure 1:
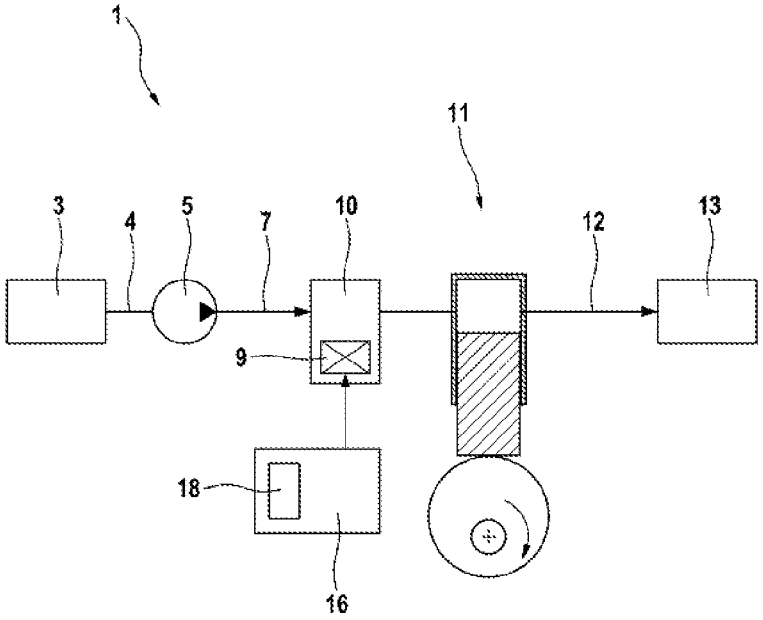
FIG. 1 shows a simplified diagram of a fuel delivery device of an internal combustion engine.

FIG. 1 shows a fuel delivery device 1 of an internal combustion engine in a highly simplified illustration. Fuel is fed from a fuel tank 3 via a suction line 4, by means of a predelivery pump 5, via a low pressure line 7 and via a quantity control valve 10, which can be activated by an electromagnetic activation device 9 ("electromagnet"), of a high pressure pump 11 (not explained further here). The high pressure pump 11 is connected to a high pressure accumulator 13 ("common rail") downstream via a high pressure line 12. Other elements such as, for example, valves of the high pressure pump 11, are not shown in FIG. 1. The electromagnetic activation device 9 is actuated by means of an open-loop and/or closed-loop control device 16 on which a computer program 18 can run.

Of course, the quantity control valve 10 can also be embodied as one structural unit with the high pressure pump 11. For example, the quantity control valve 10 can be a forced-opening inlet valve of the high pressure pump 11. Alternatively, the quantity control valve 10 can also have an activation device other than the electromagnet 9, for example a piezo-actuator.

During the operation of the fuel delivery device 1, the predelivery pump 5 delivers fuel from the fuel tank 3 into the low pressure line 7. In the process, the quantity control valve 10 controls the fuel quantity fed to a working space of the high pressure pump 11 in that an armature of the electromagnet 9 is moved from a first into a second position, and vice versa. The quantity control valve 10 can therefore be closed and opened.

Figure 2:
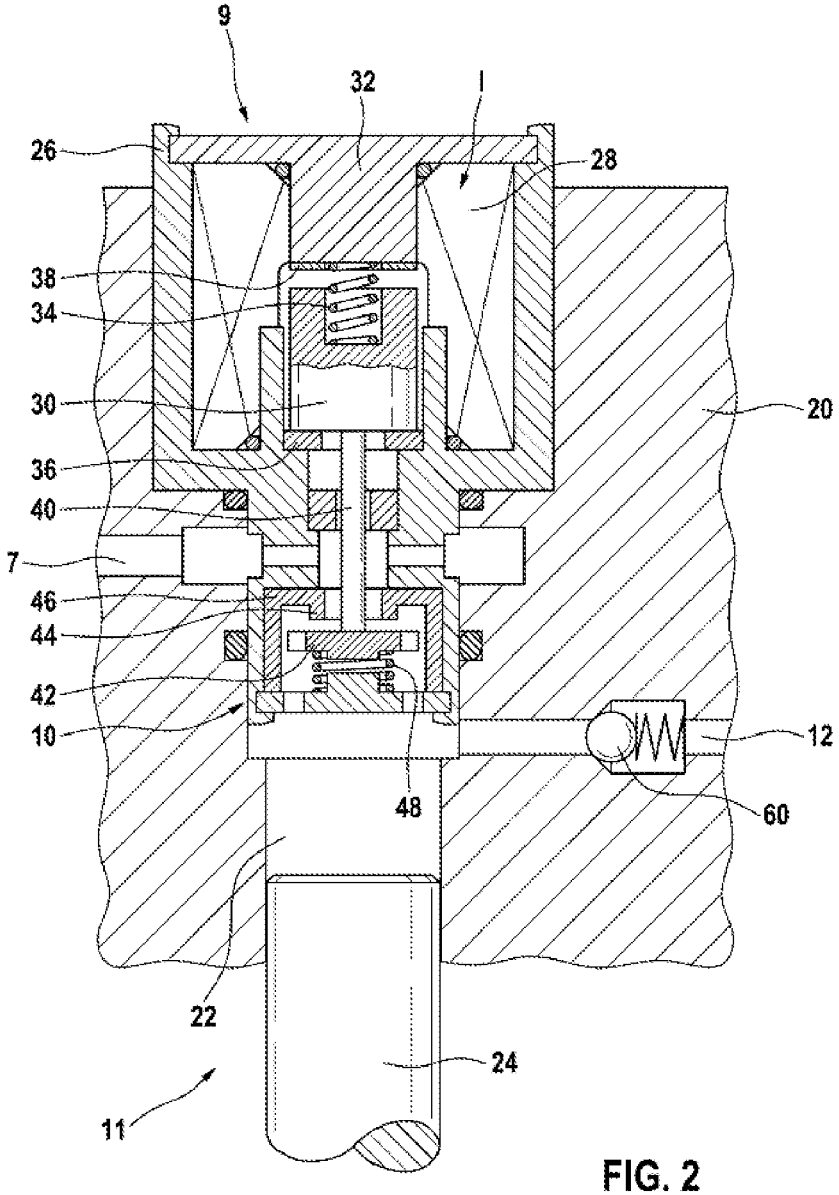
FIG. 2 shows a sectional illustration of a high pressure pump of the fuel delivery device together with a quantity control valve and an electromagnetic activation device.

FIG. 2 shows a detail of a sectional illustration (longitudinal section) of the high pressure pump 11 of the fuel delivery device 1 together with the quantity control valve 10 and the electromagnetic activation device 9. The illustrated arrangement comprises a housing 20 in which the electromagnetic activation device 9 is arranged in the upper region in the drawing, the quantity control valve 10 is arranged in the central region, and a delivery space 22 together with a piston 24 of the high pressure pump 11 is arranged in the lower region.

The electromagnetic activation device 9 is arranged in a valve housing 26 and comprises a coil 28, an armature 30, a pole core 32, an armature spring 34, a rest seat 36 and a stroke stop 38. The rest seat 36 constitutes the first position of the armature 30, and the stroke stop 38 constitutes the second position of the armature 30. The armature 30 acts on a valve body 42 by means of a coupling element 40. An associated sealing seat 44 is arranged above the valve body 42 in the drawing. The sealing seat 44 is part of a pot-shaped housing element 46 which encloses, inter alia, the valve body 42 and the valve spring 48. The sealing seat 44 and the valve body 42 form the inlet valve of the high pressure pump 11.

The non-energized state of the electromagnetic activation device 9 is illustrated in FIG. 2. In this context, the armature 30 is pressed downward in the drawing, against the rest seat 36, by means of the armature spring 34. As a result, the valve body 42 is acted on via the coupling element 40 counter to the force of the valve spring 48, as a result of which the inlet valve and/or the quantity control valve 10 are/is opened. As a result, a fluidic connection is produced between the low pressure line 7 and the delivery space 22.

In the energized state of the electromagnetic activation device 9, the armature 30 is magnetically attracted by the pole core 32, as a result of which the coupling element 40, coupled to the armature 30, is moved upward in the drawing. As a result, given corresponding fluidic pressure conditions, the valve body 42 can be pressed against the valve seat 44 by the force of the valve spring 48, and thus close the inlet valve and/or the quantity control valve 10. This can occur, for example, when the piston 24 carries out a working movement (upward in the drawing) in the delivery space 22, wherein fuel can be delivered into the high pressure line 12 via a non-return valve 60 (opened here).

The opening and/or the closing of the quantity control valve 10 occur as a function of a plurality of variables: firstly, as a function of the forces applied by the armature spring 34 and the valve spring 48. Secondly, as a function of the fuel pressure prevailing in the low pressure line 7 and the delivery space 22. Thirdly, as a function of the force of the armature 30, which force is determined substantially by a current I flowing through the coil 28 at that particular time. In particular, the current I can influence, again also as a function of the respective fuel pressures, the time of opening or closing of the valve body 42, and can therefore substantially control the quantity of fuel to be delivered.

Figure 3:
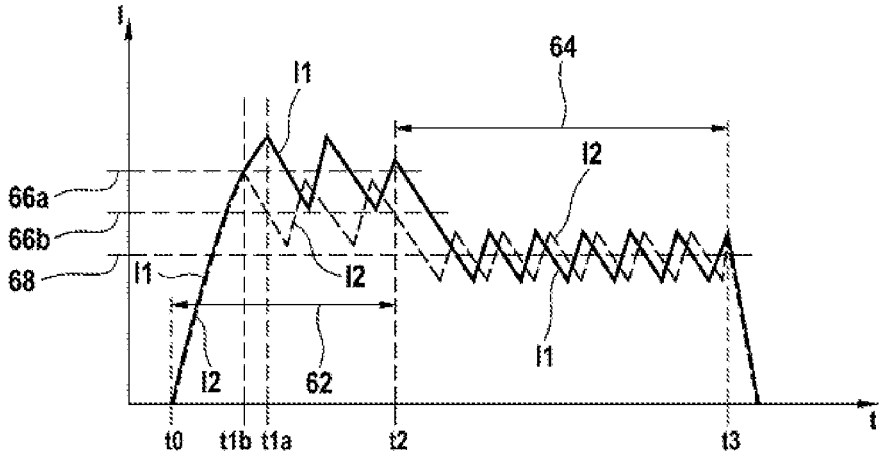
FIG. 3 shows a timing diagram of actuation of the electromagnetic activation device.

FIG. 3 shows a timing diagram of actuation of the quantity control valve 10. In the co-ordinate system illustrated in the drawing, currents I1 (continuous line) and I2 (dashed line) which flow across the coil of the electromagnetic activation device 9 are plotted against a time t. A double arrow 62 characterizes the energization for an attraction phase, and a double arrow 64 characterizes the energization for a holding phase of the armature 30 of the electromagnetic activation device 9. During the attraction phase, the armature is moved by magnetic force from the rest seat 36 as far as the stroke stop 38. During the holding phase, the armature 30 is held in its position against the stroke stop 38 by a, generally smaller, magnetic force. Below, firstly the profile of the current I1 is described, said current I1 being used to actuate the electromagnetic activation device 9 at a comparatively high rotational speed 72 (cf. FIG. 4) of the internal combustion engine.

The attraction phase begins at a time t0, wherein the current I1 rises comparatively quickly, and is clocked about a mean value 66*a* starting from a time t1a. At a time t2 the energization for the holding phase begins, wherein the current I1 is clocked about a mean value 68. The mean value 68 is lower than the mean value 66*a*. At a time t3, the actuation is ended, as a result of which the current I1 is quickly reduced to zero.

In the case of a relatively low rotational speed 72 of the internal combustion engine, the electromagnetic activation device 9 is actuated with a current I2, that is to say switching thresholds (not illustrated) which control the switching on and the switching off of the current I2 during the attraction phase, are set to lower values with respect to switching thresholds of the current I1. As a result, a correspondingly lower mean value 66*b* occurs for the profile of the current I2 during the attraction phase. The required level of energy during the attraction phase is therefore also lower and operating noise during the impacting of the armature 30 against the stroke stop 38 is reduced. In the process, at the same time an attraction duration of the armature 30 is prolonged, wherein the time difference is prolonged between t2 and t0, and as a result the attraction phase 62 is lengthened, without however the correct function of the quantity control valve 10 being adversely affected.

The switching thresholds (not illustrated) which determine the profiles of the currents I1 and I2, or the mean values 66*a* and 66*b* which result therefrom, are respectively selected in such a way that reliable impacting of the armature 30 against the stroke stop 38, and therefore reliable switching of the quantity control valve 10, are made possible in all operating cases. Due to the current I2 which is on average lower during the attraction phase, the armature 30 is accelerated with a relatively small force compared to the current I1, and said armature 30 correspondingly impacts in a delayed fashion. This is explained in more detail below with FIG. 4.

Figure 4:
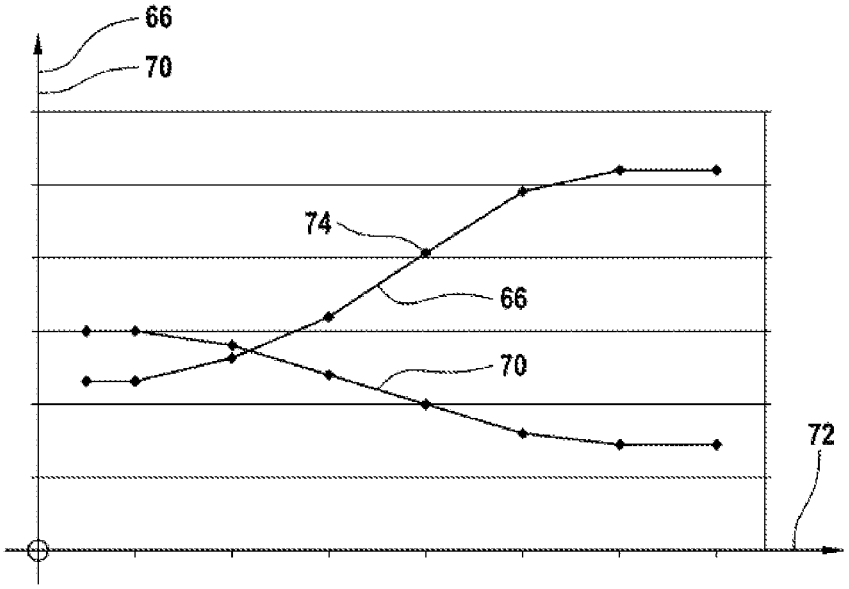
FIG. 4 shows a diagram of an attraction current and of an attraction time plotted against a rotational speed of the internal combustion engine.

FIG. 4 shows a co-ordinate system in which mean values 66 of a current I flowing via the coil 28 during the attraction phase as well as associated attraction durations 70 are plotted linearly against a rotational speed 72 of the internal combustion engine. The attraction duration 70 characterizes the time period from the beginning of the energization of the coil 28 at the time t0 up to the first impacting of the armature 30 against the stroke stop 38. The mean values 66 are determined here by reference points 74 which can be stored, for example, in a characteristic diagram of the open-loop and/or closed-loop control device 16 of the internal combustion engine. The mean values 66 of the current I also characterize an energy level which is fed to the electromagnetic activation device 9 during the attraction phase, in particular if the coil 28 is connected to a constant source voltage during the attraction phase.

It is apparent that the mean values 66 of the current I increase monotonously as the rotational speed 72 rises. If the piston 24 of the high pressure pump 11 is also moved as a function of the rotational speed 72, the possible time period to the movement of the valve body 42 or of the armature 30 becomes correspondingly shorter, that is to say more critical. This fact is allowed for suitably by the attraction durations 70 which reduce as the energization becomes stronger. This occurs, as already described above, in such a way that reliable switching of the quantity control valve 10 is made possible at any rotational speed 72.

Figure 5:
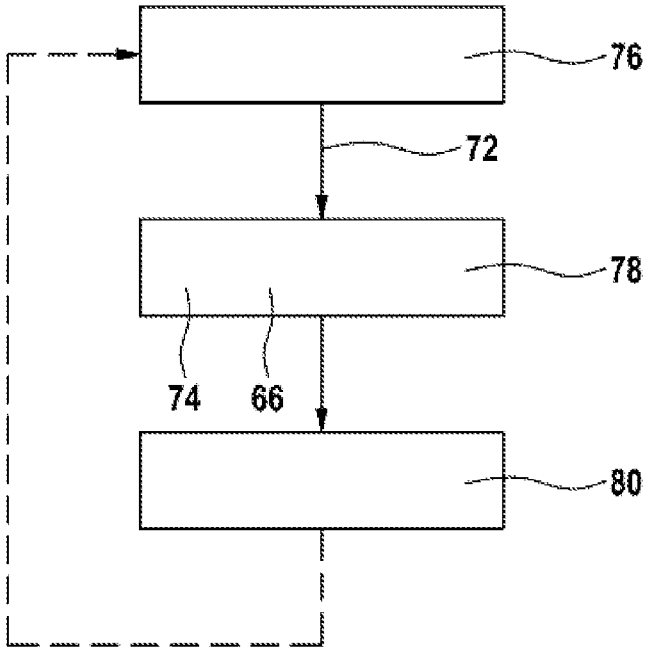
FIG. 5 shows a simplified block diagram for supplementary illustration of the method.

FIG. 5 shows a simplified flow chart of the actuation of the electromagnetic activation device 9. The illustrated method is preferably carried out by means of the computer program 18 in the open-loop and/or closed-loop control device 16 of the internal combustion engine. In a first block 76, the illustrated procedure begins, wherein the current rotational speed 72 of the internal combustion engine is determined. In a second block 78, two reference points 74 are read out from a characteristic diagram on the basis of the determined rotational speed 72. After this, interpolation is carried out between these two reference points 74 in order to determine a respective mean value 66 in a way which is precisely matched to the rotational speed 72. Suitable switching thresholds (without reference symbols) for the switching on and the switching off of the current I are determined from the mean value 66.

In a third block 80, the determined switching thresholds are used to actuate the electromagnetic activation device 9 or the coil 28 during the attraction phase of the armature 30. The method in FIG. 5 can be repeated cyclically.

The invention claimed is:

1. A method for operating a fuel delivery device of an internal combustion engine, comprising:

switching an electromagnetic activation device of a quantity control valve in order to set a delivery quantity, wherein an amount of energy which is fed to the electromagnetic activation device for the purpose of switching depends at least for a certain time on a rotational speed of the internal combustion engine, such that the amount of energy monotonically increases as a function of a rise in the rotational speed, and wherein at least one of a value of current which is fed to the electromagnetic activation device and a level of a voltage which is applied to the electromagnetic activation device depends at least for the certain time on the rotational speed of the internal combustion engine.

2. The method as claimed in claim 1, wherein the amount of energy depends on the rotational speed of the internal combustion engine only during an attraction phase during which an armature of the electromagnetic activation device is moved from a first position into a second position.

3. The method as claimed in claim 1, wherein the amount of energy is controlled in such a way that the quantity control valve is switched within a time interval corresponding to a respective rotational speed.

4. The method as claimed in claim 1, wherein the at least one of the current and the voltage is clocked.

5. The method as claimed in claim 1, wherein the quantity control valve is an inlet valve of a high pressure fuel pump, the method further comprising feeding the delivery quantity of fuel to a working space of the high pressure pump.

6. An open-loop and/or closed-loop control device of an internal combustion engine, comprising:

a memory configured to store programmed instructions that the control device recalls to operate an electromagnetic activation device of a quantity control valve to switch in order to set a delivery quantity, wherein an amount of energy which is fed to the electromagnetic activation device for the purpose of switching depends at least for a certain time on a rotational speed of the internal combustion engine, such that the amount of energy monotonically increases as a function of a rise in the rotational speed.

7. The control device of claim 6, wherein at least one of a value of current which is fed to the electromagnetic activation device and a level of a voltage which is applied to the electromagnetic activation device depends at least for the certain time on the rotational speed of the internal combustion engine.

* * * * *